US007819548B1

(12) United States Patent
Schultz et al.

(10) Patent No.: US 7,819,548 B1
(45) Date of Patent: Oct. 26, 2010

(54) PROTECTIVE SLEEVE COMBINATION FOR TUBES OF FLUORESCENT BULBS

(75) Inventors: Robert Schultz, Marietta, GA (US); Anthony Kasmar, Lawrenceville, NJ (US)

(73) Assignee: Light Lines, Inc., Marietta, GA (US)

( * ) Notice: Subject to any disclaimer, the term of this patent is extended or adjusted under 35 U.S.C. 154(b) by 604 days.

(21) Appl. No.: 11/048,062

(22) Filed: Feb. 1, 2005

(51) Int. Cl.
*F21V 21/00* (2006.01)

(52) U.S. Cl. ..... 362/217.01; 362/266; 362/377; 362/378; 362/376

(58) Field of Classification Search ..... 362/217, 362/266, 377, 378, 376
See application file for complete search history.

(56) References Cited

U.S. PATENT DOCUMENTS

| | | | | |
|---|---|---|---|---|
| 2,363,109 | A | 11/1944 | Keiffer | |
| 3,124,307 | A | 3/1964 | Hoskins et al. | |
| 3,263,109 | A | 7/1966 | Herrmann et al. | |
| 3,673,401 | A * | 6/1972 | Du Pont | 362/377 |
| 3,751,653 | A | 8/1973 | Henry | |
| 3,798,481 | A | 3/1974 | Pollara | |
| 3,808,495 | A | 4/1974 | Win | |
| 4,048,537 | A * | 9/1977 | Blaisdell et al. | 313/489 |
| 4,393,323 | A | 7/1983 | Hübner | |
| 4,924,368 | A * | 5/1990 | Northrop et al. | 362/376 |
| 4,991,070 | A * | 2/1991 | Stob | 362/223 |
| 5,188,451 | A | 2/1993 | Shanks | |
| 6,406,167 | B1 | 6/2002 | Bock | |
| 6,422,721 | B1 | 7/2002 | Plunk et al. | |
| 6,796,685 | B1 * | 9/2004 | Nemirow | 362/293 |
| 2006/0012995 | A1 * | 1/2006 | Tillotson | 362/253 |
| 2006/0034087 | A1 * | 2/2006 | Buchanan | 362/377 |

FOREIGN PATENT DOCUMENTS

| | | |
|---|---|---|
| DE | 3312669 A1 | 10/1984 |
| DE | 3740701 A1 | 6/1989 |
| GB | 1522472 | 8/1978 |

* cited by examiner

*Primary Examiner*—Sandra L O'Shea
*Assistant Examiner*—Jessica L McMillan
(74) *Attorney, Agent, or Firm*—John F. A. Earley, III; Frank J. Bonini, Jr.; Harding, Earley, Follmer & Frailey P.C.

(57) ABSTRACT

A safety sleeve apparatus comprises a safety sleeve encapsulating a fluorescent tube for protecting the fluorescent tube from physical damage and for preventing the tube from sliding out of the sleeve and breaking if the sleeve is tilted from the horizontal during installation of the tube into a pair of lamp sockets. The sleeve protects the tube from damage if the sleeve is struck by a hard object, and creates an airspace around the tube to protect the tube from cold and prevent the escape of fragments from a broken tube. The sleeve has a greater inside diameter than the outside diameter of the tube. An end cap is mounted on each end of the sleeve, and the end cap includes a cylindrical ring extending upright from the edges of a flat end wall. Projections are included in the cylindrical ring and the projections attach to the slots in the ends of the sleeve.

20 Claims, 3 Drawing Sheets

PROTECTIVE SLEEVE COMBINATION FOR TUBES OF FLUORESCENT BULBS

BACKGROUND OF THE INVENTION

1. Field of the Invention

This invention relates to protective sleeves for fluorescent lamp tubes, and more particularly concerns a safety sleeve apparatus which includes a safety sleeve encapsulating a fluorescent tube for protecting the tube from physical damage and end caps for preventing the tube from sliding out of the sleeve and breaking if the sleeve is tilted from the horizontal during installation of the tube into a pair of sockets in a lamp fixture.

This invention also relates to creating an air space around the tube to protect it from cold and increase the lumen production of fluorescent tube apparatus.

2. Description of the Prior Art

Fluorescent tubes have been provided with protective safety sleeves before, but there is a danger when installing a sleeve-protected fluorescent tube which is eight feet long, for example, that it may fall out of the sleeve when it is tilted from the horizontal while attempting to insert the tube into the sockets of the fluorescent tube receptacle. Also, it has been a problem to protect the environment from broken tube components if the tube breaks as in a refrigerated food cabinet or in a pharmaceutical hopper.

Previous fluorescent tubes with protective shields have included a sleeve with two press fit end caps, a sleeve with caps held onto the sleeve with adhesive, and a sleeve that is shrink-wrapped around the tube. In the press fit end cap assemblies, during installation the fluorescent tube could push out an end cap from the sleeve and slip out of the sleeve resulting in the fluorescent tube falling and breaking.

The tubes held in with caps affixed in the sleeve by an adhesive have the problem of not being reusable if a protective sleeve or a tube should break.

Also, the shrink-wrapped sleeve does not provide an airspace around the tube that would act as a heat insulation shield in cold environments.

Another problem is presented when fluorescent tubes are used in refrigerated or in freezer applications, as in refrigerated food cabinets, or in public garages in the winter time when the weather is cold. A fluorescent tube is designed to produce its rated lumen output when the wall temperature at the mid-point of the tube reaches 100° F. If you put a fluorescent tube into a freezer environment, the light output of the tube is severely compromised.

To summarize, the prior art safety sleeves for fluorescent lamp tubes include:

1. A sleeve with two end caps that are press fitted into the ends of the sleeve, which has the problem of the fluorescent lamp tube, due to its weight, pushing an end cap off of the end of the sleeve and the fluorescent tube sliding out of the sleeve and breaking if the sleeve is tilted from horizontal during installation of the tube into a light socket.

2. A sleeve with end caps that are held in by adhesives, which has the drawback of not being able to use the sleeve more than once, since after the fluorescent tube is spent, the sleeve is discarded with the fluorescent tube.

3. A shrinkable sleeve that is shrink-wrapped onto the fluorescent tube, which is discarded with the tube when the lamp is spent, and which does not provide an airspace between the sleeve and the fluorescent tube.

The lighting industry has moved away from fluorescent lighting in parking garages and many outdoor areas in parts of the country where they get cold weather. Many have gone to high intensity discharge fixtures because the lumen output in cold weather is better, but the system cost is high. Another disadvantage is that if power is interrupted, it takes time for the lamp/ballast to cool down to allow it to re-strike the lamp. On the other hand, fluorescent tubes are just turned off and on and do not have this problem. Also, fluorescent tubes are less expensive and consume lower wattage.

SUMMARY OF THE INVENTION

It is an object of our invention to provide a safety sleeve for a fluorescent tube that protects the fluorescent tube from physical damage and prevents the tube from sliding out of the sleeve and breaking if the sleeve is tilted from the horizontal during installation of the tube into a pair of electrical sockets in a fluorescent fixture.

It is another object of the invention to protect the fluorescent tube from damage if the sleeve is struck by a hard object and broken.

It is another object to create an airspace around the tube to protect the tube from cold and thereby increase the lumen output from the tube assembly.

These and other objects are accomplished by our invention as described below.

The present invention relates to a safety sleeve apparatus for protecting a fluorescent tube from physical damage, for preventing the tube from sliding out of a safety sleeve and breaking if the sleeve is tilted from the horizontal during installation of the tube into a pair of electrical sockets, for protecting the tube from damage if the sleeve is struck by a hard object, for creating an airspace around the lamp bulb to protect the tube from cold, and for preventing the escape of fragments from a broken tube. Means for locking the end caps onto the ends of the sleeve are provided that include a plurality of slots formed in the end portions of the sleeve, and a plurality of projections formed on the outer surface of the walls of end caps. The end cap projections are received in the sleeve slots when the end cap is pressed and twisted into the hollow sleeve end portions.

One embodiment of the locking means is a "twist-off" embodiment in' which the end cap is constructed so the end cap may be twisted off the end portion of the sleeve when desired. With this twist-off embodiment, one or both of the side walls of each cap projection is chamfered to create a ramp on which the slots may slide over to permit the end cap to be removed from the sleeve.

Another embodiment of locking means is a non-"twist-off" in which the locking means is permanent and designed not to be twisted off of the end portion of the sleeve. In a "non-twist-off" version, both side walls of each cap projection are squared off to lock the projection in the slot and prevent twisting off of the end cap from the sleeve.

In another embodiment of the invention, the safety sleeve apparatus includes an end cap which has an inner ring over which an inner sleeve may be mounted to protect the tube, thereby creating an airspace between outer and inner sleeves which acts as a heat insulation layer against the cold in the environment where the tube is placed, as in a refrigeration unit, or in a parking garage in winter months when the tube is subjected to cold air, for example.

DETAILED DESCRIPTION OF THE DRAWINGS

Figure 1:
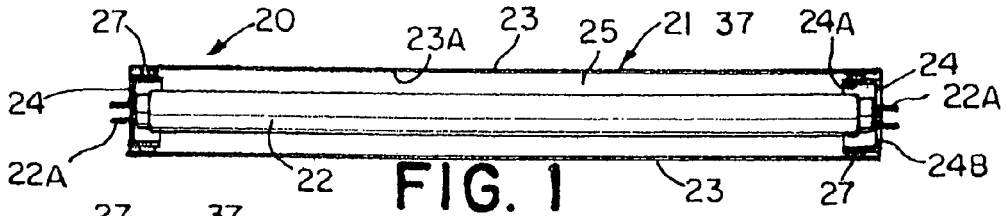
FIG. 1 is a schematic view of a fluorescent lamp assembly showing the position of various parts of the invention.

Turning now to the drawings, there is shown in FIG. 1 a fluorescent lamp tube assembly 21 that comprises a fluorescent lamp tube 22 and a safety sleeve apparatus 20 for protecting the fluorescent lamp tube 22. The safety sleeve apparatus 20 comprises an outer safety sleeve 23, encapsulating the fluorescent tube 22 for protecting the fluorescent tube 22 from physical damage, and end caps 24 preventing the tube 22 from sliding out of the sleeve 23 and breaking if the sleeve 23 is tilted from the horizontal during installation of the tube 22 into a pair of lamp sockets in a lamp fixture. Sleeve 23 protects the tube 22 from damage if the sleeve 23 is struck by a hard object. Sleeve 23 also creates an airspace 25 around the tube 22 to protect the tube 22 from cold when it is located in a cold environment, and sleeve 23 prevents the escape of fragments from a broken tube 22. The sleeve 23 has a greater inside diameter 23A than the outside diameter of the tube 22, and a greater inside diameter than the outside of the end caps 24 which are mounted at each end of the sleeve 23. End cap 24 includes a cylindrical ring or wall 24A extending upright from the edges of a flat end wall 24B. Attaching members attach the end caps 24 to the ends of the sleeve 23.

End caps 24 include four projections 27 that extend outwardly from the outer surface of the outer cylindrical ring 24A of the end cap 24.

Figures 18A, 18B, 18C:
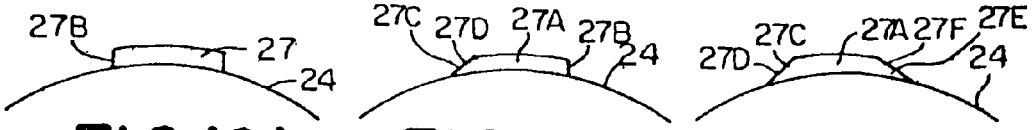
FIG. 18A is a partial view on profile of an end cap projection which is part of the means for locking the end caps to the sleeves and shows a projection with 2 square ends.
FIG. 18B is a partial view in profile of another end cap projection and shows a ramp and a square end.
FIG. 18C is a partial view in profile of another end cap projection and shows two ramps.
Figure 2:
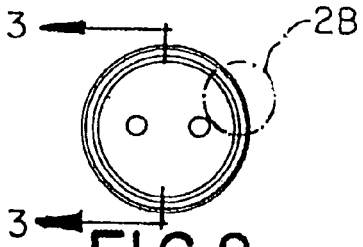
FIG. 2 is a view in top plan of the end cap of FIG. 1.
Figure 2A:
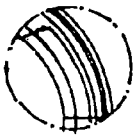
FIG. 2A is an enlarged view of the area of the end cap of FIG. 2 indicated by the circle 2B.
Figure 1B:
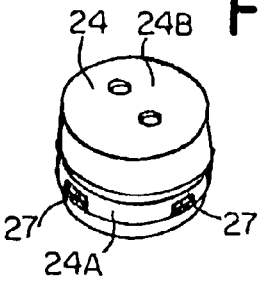
FIG. 1B is a view in perspective of an end cap which forms a part of this invention.
Figure 3:
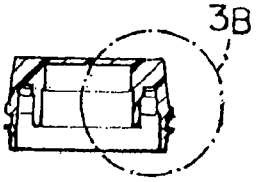
FIG. 3 is a view in section taken along the lines and arrows 3-3 of FIG. 2.
Figure 3A:
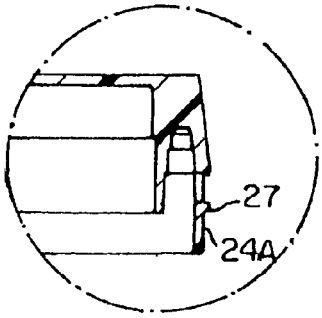
FIG. 3A is an enlarged view of the portion of the cap of FIG. 3 indicated by the circle 3B.
Figure 4:
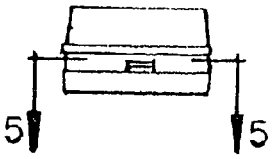
FIG. 4 is a view in side elevation of the cap FIG. 1B.
Figure 5:
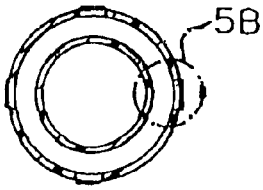
FIG. 5 is a view in section taken as indicated by the lines and arrows 5-5 in FIG. 4.
Figure 5A:
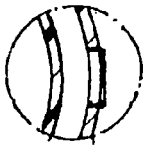
FIG. 5A is an enlarged view of the area in FIG. 5 indicated by the circle 5B.
Figure 6:
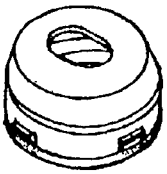
FIG. 6 is a view in perspective of another embodiment of the cap which forms a part of this invention.
Figure 7:
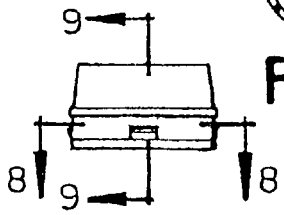
FIG. 7 is a view in elevation of the cap of FIG. 6.
Figure 8:
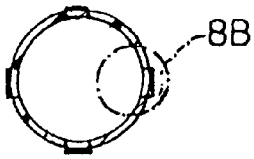
FIG. 8 is a view in section taken as indicated by the lines and arrows 8-8 in FIG. 7.
Figure 8A:
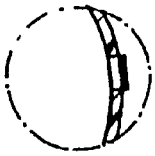
FIG. 8A is an enlarged view of the area taken as indicated by the circle 8B in FIG. 8.
Figure 9:
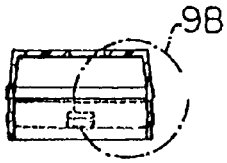
FIG. 9 is a view in section taken as indicated by the lines and arrows 9-9 in FIG. 7.
Figure 9A:
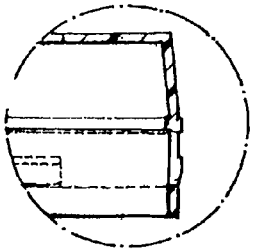
FIG. 9A is an enlarged view of the area in FIG. 9 indicated by the circle 9B.
Figure 10:
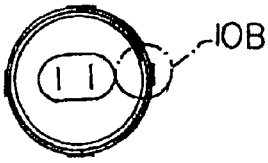
FIG. 10 is a view in top plan of the cap of FIG. 6 showing the fluorescent tube and electrical prongs extending therefrom.
Figure 10A:
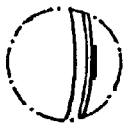
FIG. 10A is an enlarged view of the area in FIG. 10 indicated by the circle 10B.
Figure 6A:
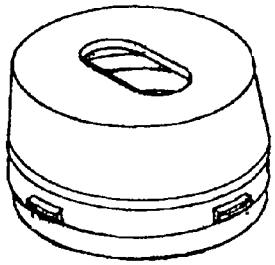
FIG. 6A is an enlarged view in perspective of the cap of FIG. 6.
Figure 9C:
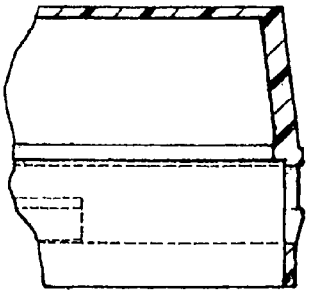
FIG. 9C is an enlarged view of FIG. 9A.
Figure 11:
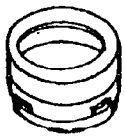
FIG. 11 is a view in perspective of another embodiment of the cap which forms a part of this invention.
Figure 12:
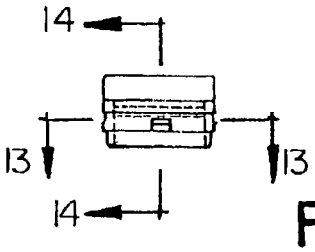
FIG. 12 is a view in side elevation of the cap of FIG. 11.
Figure 13:
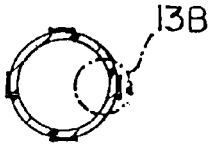
FIG. 13 is a view in section taken as indicated by the lines and arrows 13-13 in FIG. 12.
Figure 13A:
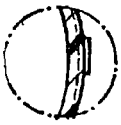
FIG. 13A is an enlarged view of the area 13B in FIG. 13.
Figure 14:
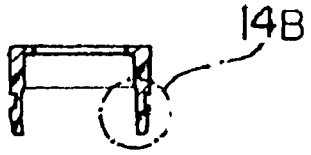
FIG. 14 is a view in section taken as indicated by the lines and arrows 14-14 in FIG. 12.
Figure 14A:
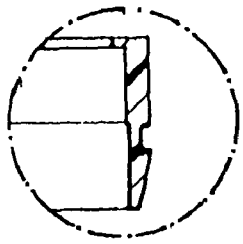
FIG. 14A is an enlarged view of the area 14B in FIG. 14.
Figure 15:
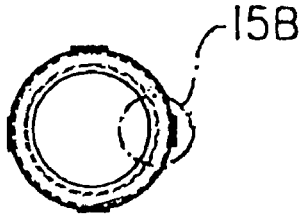
FIG. 15 is a view in top plan of the cap of FIG. 11.
Figure 15A:
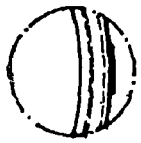
FIG. 15A is an enlarged view of the area 15B in FIG. 15.
Figure 17:
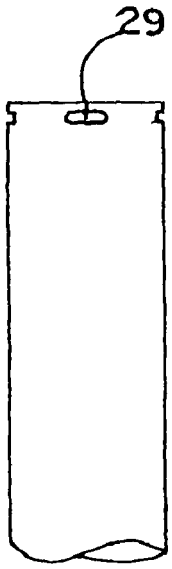
FIG. 17 is a partial view in elevation of the end of the outer sleeve shown in FIG. 16.
Figure 16:
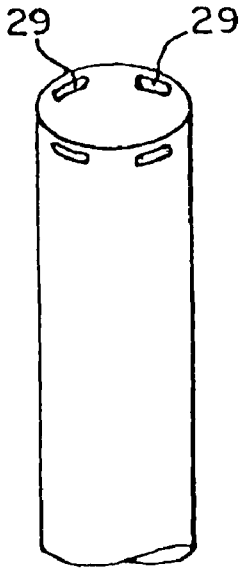
FIG. 16 is a partial view in perspective of one end of an outer sleeve which forms a part of this invention.

Projections 27, in the embodiment of the invention shown in FIG. 18A, are, in a bottom plan view, in the shape of a rectangle with square corners, and the projections 27 are square to the center axis of the end cap 24. The slots 29 formed in the end portions of the sleeve 23 are also square to the center axis of the end cap 24.

The slots 29 match the projections 27 and the end caps 24 are twisted and pushed into the end of the sleeve 23 to insert the projections 27 into the slots 29 and lock the end caps 24 onto the ends of the sleeve 23.

In another embodiment of the invention, as shown in FIG. 18B, the projection 27A has a square side wall 27B and a chamfered side wall 27D to create a ramp 27C on which the projections 27A may slide into and out of the slots 29.

In another embodiment of the invention, as shown in FIG. 18C, the projection 27A has a chamfered side wall 27D and a chamfered side wall 27E to create ramps 27C and 27F on which projections 27A may slide into and out of the slots 29 when the end cap 24 is twisted.

The plastic outer sleeve 23 is preferably made of polycarbonate, and the sleeve 23 may be transparent, or translucent or frosted.

Figure 1A:
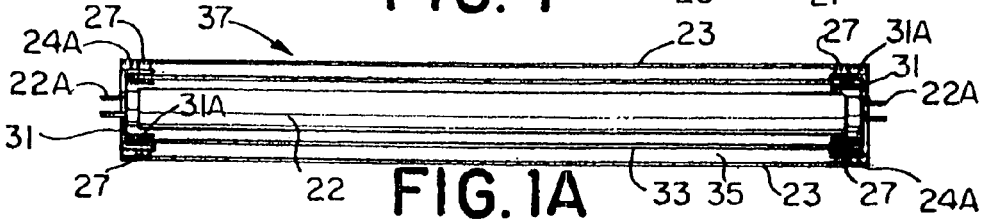
FIG. 1A is a schematic view of another embodiment showing 2 sleeves.

In a 2-ring embodiment of the invention shown in FIG. 1A, each end cap 31 of the fluorescent lamp tube assembly 37 has two rings which includes an outer ring 24A and an inner ring 31A. The inner ring 31A fits into an inner sleeve 33 that is mounted over the inner ring 31A of the end cap 31 to protect the lamp bulb tube 22 from being damaged. The inner ring 31A creates an air space 35 between the inner sleeve 33 and the outer sleeve 23. The air space 35 between the inner sleeve 33 and outer sleeve 23 acts as a heat insulation layer against the cold in a cold environment as in a refrigeration cabinet or against the cold in the winter time in a parking garage, for example. The outer ring 24A, having projections 27 or 27A described above, is twisted into the sleeve 23 to insert the projections 27 into the slots 29 of the sleeve 23 to lock the end cap 31 onto the end of the sleeve 23.

As shown in the drawings, the outer end portion of the end caps 24, 31 has a portion that blocks the fluorescent tube 22 from falling out of the sleeve 23 when the fluorescent tube 22 is tilted from the horizontal during installation of the tube 22 into a pair of sockets in a lamp fixture. Further, the outer end portion of the end caps 24, 31 has an opening (or openings) that permits the electrical prongs 22A of the fluorescent tube 22 to project from the sleeve 23 past the end caps 24, 31 for insertion into electrical sockets.

A method of installing a fluorescent lamp bulb tube 22 into a fluorescent lamp bulb fixture having electrical sockets comprises the steps of providing a fluorescent tube 22 having a electrical prongs 22A at each end, and encapsulating the fluorescent tube 22 in a protective sleeve 23 having two ends. A pair of end caps 24 are affixed to the ends of a sleeve 23 thereby attaching the end caps 24 to the sleeve 23 to form a fluorescent tube assembly 21. The end caps 24 have an outer ring 24A and projections 27 or 27A extending outwardly from the outer surface of the outer ring 24A. The end caps 24 are twisted into the sleeve 23 to insert the projections 27 or 27A into the slots 29 of the sleeve 23. This action locks the end caps 24 into the ends of the sleeves 23. This prevents the fluorescent tube 22 from falling out of the sleeve 23 when the fluorescent tube 22 is tilted from the horizontal while attempting to insert it into electrical sockets. The method further includes raising the fluorescent tube assembly 21 to the level of the electrical sockets and inserting the electrical prongs 22A of the fluorescent tube 22 into the electrical sockets.

The inventive method optionally includes the step of replacing a fluorescent tube 22, such as when it becomes spent, with a replacement fluorescent tube 22. This replacement step is accomplished by removing the fluorescent tube assembly 21 from the sockets of the fluorescent lamp bulb fixture, removing the projections 27 or 27A of the end cap 24 from the slots 29 in the sleeve 23 by twisting off the end cap 24 from either end or both ends of the sleeve 23 to enable the fluorescent tube 22 contained in the sleeve 23 to be removed from the sleeve 23, and, using a replacement fluorescent tube 22, following the steps of installing a fluorescent lamp bulb tube 22 into a fluorescent lamp bulb fixture as set out above.

Another method of installing a fluorescent tube 22 into a fluorescent lamp fixture having electrical sockets, and protecting the fluorescent tube 22 from cold in a cold environment and protecting it from breakage, comprises the steps of providing a fluorescent tube 22 having electrical prongs 22A at each end, and encapsulating the fluorescent tube 22 in an inner sleeve 33 to form an inner air space 35 between the inner sleeve 33 and the fluorescent tube 22, encapsulating the fluorescent tube 22 and the inner sleeve 33 in an outer sleeve 23 having slots 29 in its end portions, forming an airspace 35 between the inner sleeve 33 and the outer sleeve 23, providing the outer surface of the outer ring 24A of the end cap 31 with projections 27 or 27A extending outwardly from the outer ring 24A of the end cap 31, affixing the end caps 31 to the ends of the sleeves 23 and 33 by twisting the end caps 31 into the sleeves 23 and 33 and inserting the projections 27 or 27A extending outwardly from the outer surface of the outer ring 24A into the slots 29 of the sleeve 23 to lock the end caps 31 onto the sleeve 23 and to form a fluorescent lamp tube assembly 37, and preventing the fluorescent tube 22 from falling out of the sleeve 23 if the fluorescent lamp tube assembly 37 is tilted from the horizontal while attempting to insert it into electrical sockets, raising the fluorescent tube assembly 37 to the level of the electrical sockets, and inserting the electrical prongs 22A of the fluorescent tube 22 into the electrical sockets. The inventive method optionally includes the step of replacing a fluorescent tube 22, such as when it becomes spent, with a replacement fluorescent tube 22. This replacement step is accomplished by removing the fluorescent lamp tube assembly 37 from the sockets of the fluorescent lamp bulb fixture, removing the projections 27 or 27A of the end cap 31 from the slots 29 in the sleeve 23 by twisting off the end cap 31 from either end or both ends of the sleeve 23 to enable the fluorescent tube 22 contained within the sleeves 23 and 33 to be removed therefrom, and, using a replacement fluorescent tube 22, following the steps of installing a fluorescent lamp bulb tube 22 into a fluorescent lamp bulb fixture, using 2-ring end caps 31, as set out above.

The invention claimed is:

1. A fluorescent lamp assembly, comprising a fluorescent lamp tube, an outer sleeve encapsulating the fluorescent lamp tube and having a greater inside diameter than the outside diameter of the fluorescent lamp tube, the outer sleeve having a first end portion and a second end portion, an inner sleeve located between the outer sleeve and the fluorescent lamp tube and having a greater inside diameter than the outside diameter of the fluorescent lamp tube and an outside diameter less than the inside diameter of the outer sleeve, the inner sleeve having a first end portion and a second end portion, a first end cap mounted on the first end portion of the sleeves, a second end cap mounted on the second end portions of the sleeves, and means attaching the first end caps to the first end portions of the sleeves and attaching the second end cap to the second end portions of the sleeves for preventing the tube from sliding out of the sleeves and breaking if the sleeves are tilted from the horizontal during installation of the tube into a pair of electrical sockets in a lamp fixture, and for creating an inner air space between the fluorescent lamp tube and the inner sleeve and creating an outer air space between the inner and outer sleeves.

2. The fluorescent lamp assembly of claim 1, said end cap attaching means including means removably locking the end caps to the ends of the outer sleeve for preventing the tube from sliding out of the sleeves and breaking if the sleeves are tilted from the horizontal during installation of the tube into a pair of electrical sockets in a lamp fixture, and for allowing, when desired, the end caps to be unlocked and removed from the sleeves for re-use of the end caps and sleeves.

3. A fluorescent lamp assembly, comprising a fluorescent lamp tube, an outer sleeve encapsulating the fluorescent lamp tube and having a greater inside diameter than the outside diameter of the fluorescent lamp tube, an inner sleeve located between the outer sleeve and the fluorescent lamp tube and having a greater inside diameter than the outside diameter of the fluorescent lamp tube and an outside diameter less than the inside diameter of the outer sleeve, an end cap mounted on each end of the sleeves, and means attaching the end caps to the ends of the sleeves and creating an inner air space between the fluorescent lamp tube and the inner sleeve and creating an outer air space between the inner and outer sleeves, said end cap having an inner cylindrical ring and an outer cylindrical ring extending upright from a flat end wall, and said end cap attaching means including a number of projections extending outwardly from the outside surface of the outer cylindrical ring of the end cap, said end cap attaching means also including a number of slots formed in the end portions of the outer sleeve adapted to receive said projections to hold the end cap to the outer sleeve, said slots of the sleeve matching the projections of the end caps to allow for twisting the end caps into the sleeve to insert the projections into the slots of the sleeve to lock the end caps onto the sleeves.

4. A safety sleeve apparatus for a fluorescent lamp tube, comprising a safety sleeve for encapsulating a fluorescent lamp tube for protecting the fluorescent lamp tube from physical damage, an end cap mounted on each end of the sleeve, means removably locking the end caps to the ends of the sleeve for preventing the tube from sliding out of the sleeve and breaking if the sleeve is tilted from the horizontal during installation of the tube into a pair of electrical sockets in a lamp fixture, and for allowing, when desired, the end caps to be unlocked and removed from the sleeve for re-use of the end caps and the sleeve, said safety sleeve creating an air space around the tube, said safety sleeve also preventing the escape of fragments from a tube if the tube breaks, and the sleeve having a greater inside diameter than the outside diameter of the tube.

5. The safety sleeve apparatus of claim 4, each end cap including a cylindrical ring extending upright from the edges of an end wall, the cylindrical ring having an outer surface, the means removably locking the end caps to the ends of the sleeve including a number of projections extending outwardly from the outer surface of the cylindrical ring of the end cap, the means removably locking the end caps to the ends of the sleeve also including a number of slots formed in the end portions of the sleeve, said slots matching the projections to allow for twisting the end caps into the sleeve to insert the projections into the slots of the sleeve lock the end caps onto the ends of the sleeve.

6. The safety sleeve apparatus of claim 5, said projections having a square side wall, and a chamfered side wall to create a ramp on which the projections slide into and out of the slots.

7. A safety sleeve assembly for a fluorescent lamp tube, comprising a hollow plastic outer sleeve for enclosing and protecting the fluorescent tube, the hollow outer sleeve having a first end portion and a second end portion, an end cap mounted on each end portion of the hollow outer sleeve for closing the ends of the sleeve with the fluorescent tube held therein, and means for locking the end caps onto the end portion of the outer sleeve, said locking means including a plurality of slots formed in the end portions of the outer sleeve and plurality of projections extending outwardly from an outer ring formed on the end caps that are received in the slots when the end cap is pressed into the hollow outer sleeve end portions.

8. The safety sleeve assembly of claim 7, said plastic outer sleeve being made of polycarbonate.

9. The safety sleeve assembly of claim 7, the sleeve being transparent, or translucent, or frosted.

10. The safety sleeve assembly of claim 7 the locking means being removable locking means for allowing the removal of the end caps from the outer sleeve and re-use of the end caps and the sleeve.

11. The safety sleeve assembly of claim 7, each end cap having an inner ring, an inner sleeve mounted over the inner ring to protect the fluorescent lamp tube, an airspace between the inner and outer sleeves which acts as a heat insulation layer against the cold in a cold environment as in a refrigeration cabinet or against the cold air in the winter time in a parking garage.

12. A fluorescent lamp assembly for protecting a fluorescent lamp tube, comprising a fluorescent lamp tube, a hollow plastic outer sleeve encapsulating the fluorescent lamp tube, the hollow outer sleeve having a first end portion and a second end portion, an end cap mounted on each end portion of the hollow outer sleeve for closing the ends of the sleeve with the fluorescent tube held therein, and means for locking the end caps onto the end portion of the outer sleeve, said locking means including a plurality of slots formed in the end portions of the outer sleeve and a plurality of projections extending outwardly from an outer ring formed on the end caps that are received in the slots when the end cap is pressed into the hollow outer sleeve end portions.

13. The fluorescent lamp assembly of claim 12, each end cap having an inner ring, an inner sleeve mounted over the inner ring to protect the fluorescent lamp tube, an airspace between the inner and outer sleeves which acts as a heat insulation layer against the cold in a cold environment as in a refrigeration cabinet or against the cold air in the winter time in a parking garage.

14. The fluorescent lamp assembly of claim 12, the locking means being removable locking means for allowing the removal of the end caps from the outer sleeve and re-use of the end caps and the sleeve.

15. A method of installing a fluorescent lamp bulb tube into a fluorescent lamp fixture having electrical sockets, comprising providing a fluorescent lamp bulb tube having electrical prongs at each end, encapsulating the fluorescent tube in a protective sleeve having two ends, affixing a pair of end caps to the ends of the sleeve to thereby attach the end caps to the sleeve and form a fluorescent tube assembly, said end cap having an outer ring and projections extending outwardly from the outer ring, said sleeve having an end portion at each end of the sleeve and a number of slots formed in the end portions of the sleeve adapted to receive the projections to lock the end caps to the sleeve, twisting the end caps relative to the sleeve and inserting the cap projections into the slots of the sleeve to lock the end caps onto the ends of the sleeve, preventing the fluorescent tube from falling out of the sleeve if the fluorescent tube assembly is tilted from the horizontal while attempting to insert it into electrical sockets by blocking removal of the fluorescent tube from the sleeve with the end caps, raising the fluorescent tube assembly to the level of the electrical sockets, and inserting the electrical prongs of the fluorescent tube into the electrical sockets.

16. A method of installing a fluorescent tube into a fluorescent lamp fixture having electrical sockets, and protecting the fluorescent tube from cold in a cold environment and protecting it from breakage, comprising providing a fluorescent tube having electrical prongs at each end, encapsulating the fluorescent tube in an inner sleeve and forming an inner air space between the inner sleeve and the fluorescent tube, encapsulating the fluorescent tube and the inner sleeve in an outer sleeve having slots in its end portions, forming an airspace between the inner and outer sleeves, providing end caps having projections extending outwardly from an outer ring of the end cap, affixing the end caps to the ends to the sleeves and forming a fluorescent tube assembly, twisting the end caps relative to the outer sleeve to insert the projections of the end caps into the slots of the sleeve to lock the end caps onto the end portions of the sleeve, preventing the fluorescent tube from falling out of the sleeve if the fluorescent tube assembly is titled from the horizontal while attempting to insert it into the electrical sockets by blocking removal of the fluorescent tube from the sleeve with the end caps, raising the fluorescent tube assembly to the level of the electrical sockets, and inserting the electrical prongs of the fluorescent tube into the electrical sockets.

17. A safety sleeve assembly for a fluorescent lamp tube, comprising an outer sleeve encapsulating the fluorescent lamp tube and having a greater inside diameter than the outside diameter of the fluorescent lamp tube, the outer sleeve having a first end portion and a second end portion, an inner sleeve located between the outer sleeve and the fluorescent lamp tube and having a greater inside diameter than the outside diameter of the fluorescent lamp tube and an outside diameter less than the inside diameter of the outer sleeve, the inner sleeve having a first end portion and a second end portion, a first end cap mounted on the first end portions of the sleeves, a second end cap mounted on the second end portions of the sleeves, and means attaching the first end cap to the first end portions of the sleeves and attaching the second end cap to the second end portions of the sleeves for preventing the fluorescent lamp tube from sliding out of the sleeves and breaking if the sleeves are tilted from the horizontal during installation of the tube into a pair of electrical sockets in a lamp fixture and for creating an inner air space between the fluorescent lamp tube and the inner sleeve and creating an outer air space between the inner and outer sleeves.

18. The safety sleeve assembly of claim 17, the attaching means including an inner cylindrical ring and an outer cylindrical ring extending upright from a flat end wall of each end cap, the inner sleeve being mounted on the inner cylindrical ring, and said end cap attaching means including a number of projections extending outwardly from the outside surface of the outer cylindrical ring of the end cap, said end cap attaching means also including a number of slots formed in the end portions of the outer sleeve adapted to receive said projections to hold the end cap to the outer sleeve, said slots of the sleeve matching the projections of the end caps to allow for twisting the end caps into the sleeve to insert the projections into the slots of the sleeve to lock the end caps onto the sleeves.

19. The safety sleeve assembly of claim 17, said end cap attaching means including means removably locking the end caps to the ends of the outer sleeve for preventing the tube from sliding out of the sleeves and breaking if the sleeves are tilted from the horizontal during installation of the tube into a pair of electrical sockets in a lamp fixture, and for allowing, when desired, the end caps to be unlocked and removed from the sleeves for re-use of the end caps and sleeves.

20. A fluorescent lamp assembly, comprising a fluorescent lamp tube, a safety sleeve for encapsulating a fluorescent lamp tube for protecting the fluorescent lamp tube from physical damage, an end cap mounted on each end of the sleeve, and means removably locking the end caps to the ends of the sleeve for preventing the tube from sliding out of the sleeve and breaking if the sleeve is tilted from the horizontal during installation of the tube into a pair of electrical sockets in a lamp fixture, and for allowing, when desired, the end caps to be unlocked and removed from the sleeve for re-use of the end caps and the sleeve, said safety sleeve creating an air space around the tube, said safety sleeve also preventing the escape of fragments from a tube if the tube breaks, the sleeve having a greater inside diameter than the outside diameter of the tube.

* * * * *